US005555944A

United States Patent [19]

Kimoto

[11] Patent Number: 5,555,944

[45] Date of Patent: Sep. 17, 1996

[54] TWIN-SCRAPE DOZER

[75] Inventor: Kenzo Kimoto, Hirakata, Japan

[73] Assignee: Kabushiki Kaisha Komatsu Seisakusho, Tokyo, Japan

[21] Appl. No.: 301,866

[22] Filed: Sep. 6, 1994

[30] Foreign Application Priority Data

Sep. 8, 1993 [JP] Japan ..... 5-247515

[51] Int. Cl.[6] ..... E02F 3/76

[52] U.S. Cl. ..... 172/787; 172/826; 37/410; 37/409

[58] Field of Search ..... 172/787, 786, 172/821, 826, 812; 37/403, 404, 405, 406, 407, 408, 409, 411; 403/343, 43

[56] References Cited

U.S. PATENT DOCUMENTS

| | | | |
|---|---|---|---|
| 2,332,561 | 10/1943 | Drott | 37/406 |
| 2,455,474 | 12/1948 | Drott et al. | 37/406 X |
| 2,812,595 | 11/1957 | Drott | 37/409 |
| 2,824,391 | 2/1958 | Roemer | 37/409 |
| 2,846,094 | 8/1958 | Pilch | 37/403 X |
| 2,874,489 | 2/1959 | Orjala | 37/410 |
| 3,074,190 | 1/1963 | Wahl | 37/405 X |
| 3,243,067 | 3/1966 | Artman | 37/406 X |
| 3,243,905 | 4/1966 | Ulrich | 37/406 |
| 3,296,720 | 1/1967 | Sagerer | 37/406 |
| 3,336,684 | 8/1967 | Ulrich | 37/406 |
| 3,375,595 | 4/1968 | Beltrami | 37/406 |
| 3,421,236 | 1/1969 | Moyer | 37/409 |
| 3,738,030 | 6/1973 | Olinger | 37/409 |
| 3,837,753 | 9/1974 | Weiste et al. | 403/343 |
| 3,854,608 | 12/1974 | Arnold | 37/406 X |
| 4,080,746 | 3/1978 | Frazzini | 37/403 |
| 4,411,584 | 10/1983 | Shumaker | 37/403 |
| 4,566,844 | 1/1986 | Campin | 37/409 X |
| 4,593,766 | 6/1986 | Gossard | 37/403 X |
| 4,825,567 | 5/1989 | Andiano et al. | 37/403 X |
| 5,000,269 | 3/1991 | Aoki et al. | 37/403 X |

FOREIGN PATENT DOCUMENTS 1-31632 9/1989 Japan .

*Primary Examiner*—Terry Lee Melius
*Assistant Examiner*—Victor Batson
*Attorney, Agent, or Firm*—Richards, Medlock & Andrews

[57] ABSTRACT

A twin-scrape dozer, capable of maintaining a satisfactory balance during earth loading, of loading a larger quantity of earth, of efficiently conveying earth even over a soft ground, and of adjusting the rate at which earth is scattered, has a crawler type tractor (1, 1A) equipped with a traveling mechanism, a front earth loading and ejecting device (10, 50), and a rear earth loading and ejecting device (30, 70). The traveling mechanism has track frames (2, 2A) at right and left sides of the vehicle (1, 1A), track shoes (5, 5A) and drive units (6, 6A). The earth loading and ejecting devices are provided at the front and rear parts of the vehicle (1, 1A), and are installed to be vertically movable with lift cylinders (13, 33, 56, 78). Each of the earth loading and ejecting devices is provided with a scraper (21, 34, 53, 75) and a bowl member (14, 41, 61, 81) pivotably connected together by pivot pins (22, 42, 62, 83). Each scraper (21, 34, 53, 75) and bowl member (14, 41, 61, 81) are controlled by a bowl cylinder (23, 43, 63, 84), so that the bottom of the bowls (20, 40, 60, 80) can be opened and closed by extending and retracting the respective bowl cylinders (23, 43, 63, 84). The excavating angle of the scrapers (21, 34, 53, 72) can be changed by extending and retracting the tilt cylinders (16, 36) or by adjusting the length of variable length braces (57, 73).

18 Claims, 14 Drawing Sheets

FIG. 11(A) → FIG. 11(B) → FIG. 11(C)
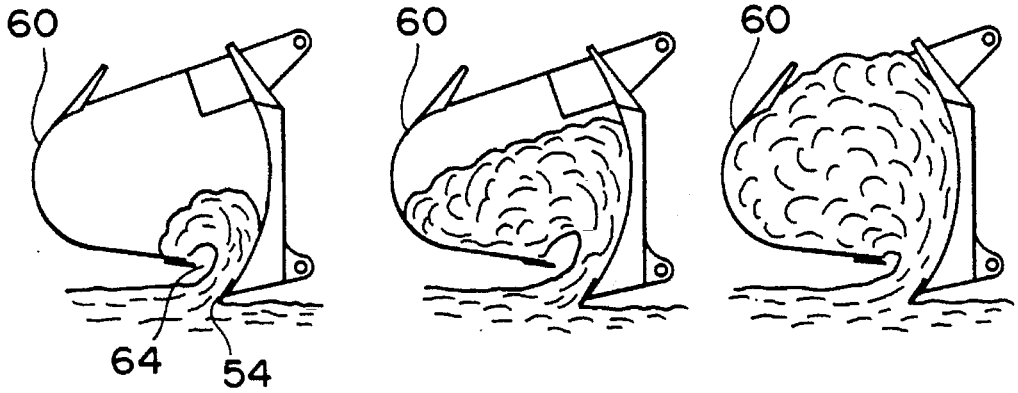
FIG. 12(A) → FIG. 12(B) → FIG. 12(C)
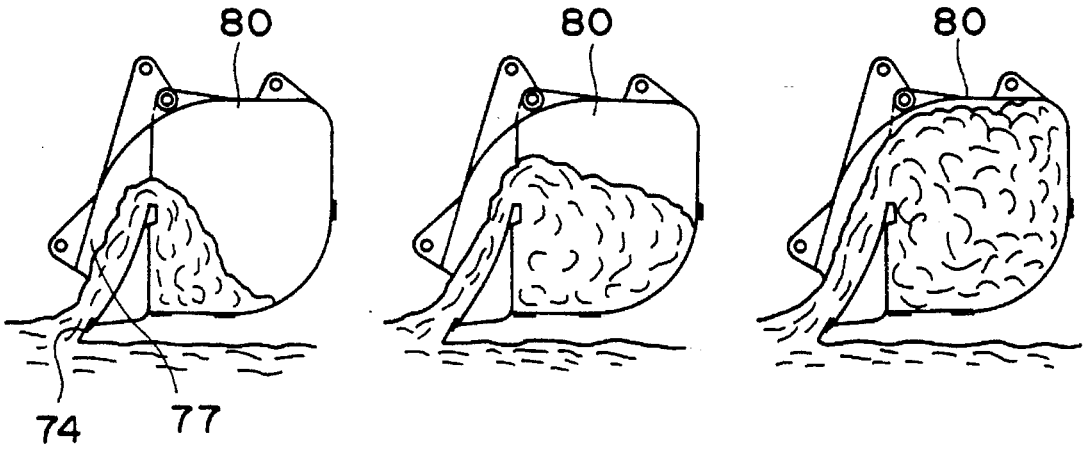

TWIN-SCRAPE DOZER

FIELD OF THE INVENTION

The present invention relates to a crawler type construction machine which is capable of excavating, loading, conveying, scattering and leveling earth.

BACKGROUND OF THE INVENTION

Various methods are available for excavating and conveying earth. In particular, a method using a wheeled vehicle machine and a method using a tracked vehicle machine are available for conveying earth while continuing an excavation operation on an irregular or soft ground. The wheeled vehicle machine is suitable for long range conveyance over a relatively hard ground, while the tracked vehicle machine is suitable for short range conveyance over an irregular or soft ground.

Earth excavating and conveying methods using a tracked vehicle machine are described below:

A first method for excavating, scraping and conveying earth involves a blade 101 provided at the front part of a bulldozer 100, shown in FIG. 15.

A second method for earth movement involves a scrape dozer 110, shown in FIG. 16. While moving forwardly, the scrape dozer 110 lowers a bowl 111, which is provided at its front part. Simultaneously, an apron 112 is opened, and excavated earth is loaded into the bowl 111 while additional earth is excavated by a cutting edge 113. When loading of the bowl 111 is finished, the bowl 111 is lifted upwardly, the apron 112 is closed, and the scrape dozer 110 conveys the excavated earth to a specified location. For scattering earth from the bowl 111, the apron 112 is opened and earth is pushed out of the bowl 111 by an ejector 114.

A third method for earth movement involves towing a trailing wheeled scraper 120, shown in FIG. 17. The trailing wheeled scraper 120 lowers the bowl 121 while advancing. Simultaneously, the wheeled scraper 120 opens the apron 122 and loads earth into the bowl 121 while continuing the excavating operation. When the loading of the bowl 121 is finished, the bowl 121 is lifted upwardly, the apron 122 is closed, and the excavated earth is conveyed by the wheeled scraper 120 to a specified location. For scattering earth from the bowl 121, the apron 122 is opened and earth is pushed out of the bowl 121 by the ejector 123.

A fourth method uses a bucket dozer 130, shown in FIG. 18, as proposed in Japanese Utility Model Application Laid-open No. (Y2) 1-31632. A bucket 133, which is pivoted about a pin 132, is provided at the front part of the tractor 131 and, in excavation and loading, excavated earth is loaded into the bucket 133 while additional earth is excavated by the cutting edge 134. For conveying the excavated earth, the bucket 133 is lifted upwardly by the lifting cylinder 135 and the bucket dozer 130 then conveys the excavated earth to the specified location. For scattering earth from the bucket 133, the bucket 133 is pivoted about pins 132 by the bucket cylinder 136, as shown with a two dot broken line in FIG. 18.

However, the methods using the above-described types of equipment include the problems as described below.

In the first method using the bulldozer 100, a large frictional resistance is caused since excavated earth is conveyed by pushing earth collected in front of the blade 101. In addition, the vehicle speed is slow, and earth drops out from both sides of the blade 101. Therefore, the earth excavating and conveying work is inadequate.

In the second method using the scrape dozer 110, the bowl 111 into which excavated earth is loaded is located in front of the center of the vehicle machine. Therefore, the center of gravity is excessively shifted to the front part of the vehicle machine when the bowl is filled with earth, and a uniform distribution of ground contact pressure by the track shoes cannot be maintained. Accordingly, the track shoes of the scrape dozer 110 are liable to slip, a large tractive force cannot be obtained, and the vehicle machine refrains from entering into a soft ground. In addition, the amount of earth conveyed per unit of vehicle weight is small.

In the third method using the trailing wheeled scraper 120, the vehicle machine cannot be operated on a soft ground because of the wheels. In addition, the trailing wheel scraper 120 cannot be retracted. Therefore, the working conditions are limited, and the work is inefficient.

In the fourth method using the bucket dozer 130, the bowl 133 for loading earth is provided only at the front part of the vehicle. Therefore, during the conveyance of loaded earth the center of gravity is shifted to the front part of the vehicle, the vehicle is unbalanced, and the distribution of ground contact pressure is not uniform. Accordingly, the track shoes of the bucket dozer 130 are liable to slip. It is also difficult for the bucket dozer to work on a soft ground. The amount of earth conveyed per unit of vehicle weight is small. In addition, it is difficult to adjust the rate at which earth is to be ejected during an operation of scattering earth.

SUMMARY OF THE INVENTION

An object of the present invention made in view of the above problems is to provide a twin-scrape dozer capable of maintaining a satisfactory balance even during loading a large amount of earth, of adjusting a rate at which earth is to be ejected during an earth scattering operation, of working even on a soft ground, and of efficiently conveying earth along long distances.

In accordance with the present invention a crawler type tractor is equipped with a traveling mechanism and front and rear earth loading and ejecting devices. The traveling mechanism comprises a track frame, track shoes and a drive unit at each of the left and right sides of the tractor. The earth loading and ejecting devices are provided at the front and rear ends of the tractor, and each of the earth loading and ejecting devices is installed to be vertically movable by at least one lift cylinder. Each of these earth loading and ejecting devices is provided with a scraper and a bowl member joined together by pivot pins. Each scraper is also pivotably coupled to its associated bowl member by at least one bowl cylinder, whereby a bottom opening between a scraper and its associated bowl member can be opened and closed by the extension and retraction of the respective at least one bowl cylinder.

Each bowl member can be pivotably mounted on a respective pair of left and right frame members, which in turn are pivotably mounted on the left and right track frames of the twin-scrape dozer. The front bowl member can also be pivotably coupled to its associated frame members by at least one tilt cylinder so that the excavating angle of the front scraper is changed by the extension and retraction of this at least one tilt cylinder. The rear scraper can be pivotably coupled by at least one tilt cylinder to a rear bracket, fixed at the rear part of the twin-scrape dozer, so that the excavating angle of the rear scraper is changed by extension and retraction of this at least one tilt cylinder.

In each earth loading and ejecting device, the scraper and the bowl member, which are installed to be pivotable with respect to each other, are directly or indirectly pivotably coupled to each other by a bowl cylinder whereby the bottom of the scraper and the bottom of the bowl member can be moved away from and toward each other by extension and retraction of the bowl cylinder, thereby opening and closing an ejection port between the scraper and the bowl member.

The earth loading and ejecting device can be pivotably coupled to the frame of the tractor by at least one brace having an adjustable length, and the excavating angle of the scraper can be changed by adjusting the length of this at least one brace. A lower end portion of the rear bracket, which is fixed at the rear part of the twin-scrape dozer, and the lower end portion of the rear scraper can be pivotably coupled to each other by a link member, while an upper end portion of the rear bracket and an upper end portion of the scraper can be pivotably coupled to each other by at least one adjustable length brace to form a four-node linkage. The excavating angle of the scraper can be changed by adjusting the length of the at least one adjustable length brace.

In the above construction, each earth loading and ejecting device is provided to be vertically movable at one of the front end and the rear end of the crawler type tractor. Therefore, the vehicle machine can be well balanced even when earth is loaded in the bowls and the amount of earth to be conveyed per unit vehicle weight is large. Moreover, the twin-scrape dozer can be used on a soft ground, and the traveling speed of the twin-scrape dozer while conveying earth can be faster.

In addition, the rate at which conveyed earth is to be scattered can be adjusted by controlling the size of an ejection port of the earth loading and ejecting device. Furthermore, the excavating angle of the scraper can be adjusted in accordance with the nature of soil conditions to ensure higher operation efficiency.

BRIEF DESCRIPTION OF THE DRAWINGS

FIGS. 12(A),12(B) and 12(C) are illustrations of an earth excavating and loading operation of the rear bowl with the second embodiment of the invention;

DETAILED DESCRIPTION OF THE PREFERRED EMBODIMENTS

Figure 1:
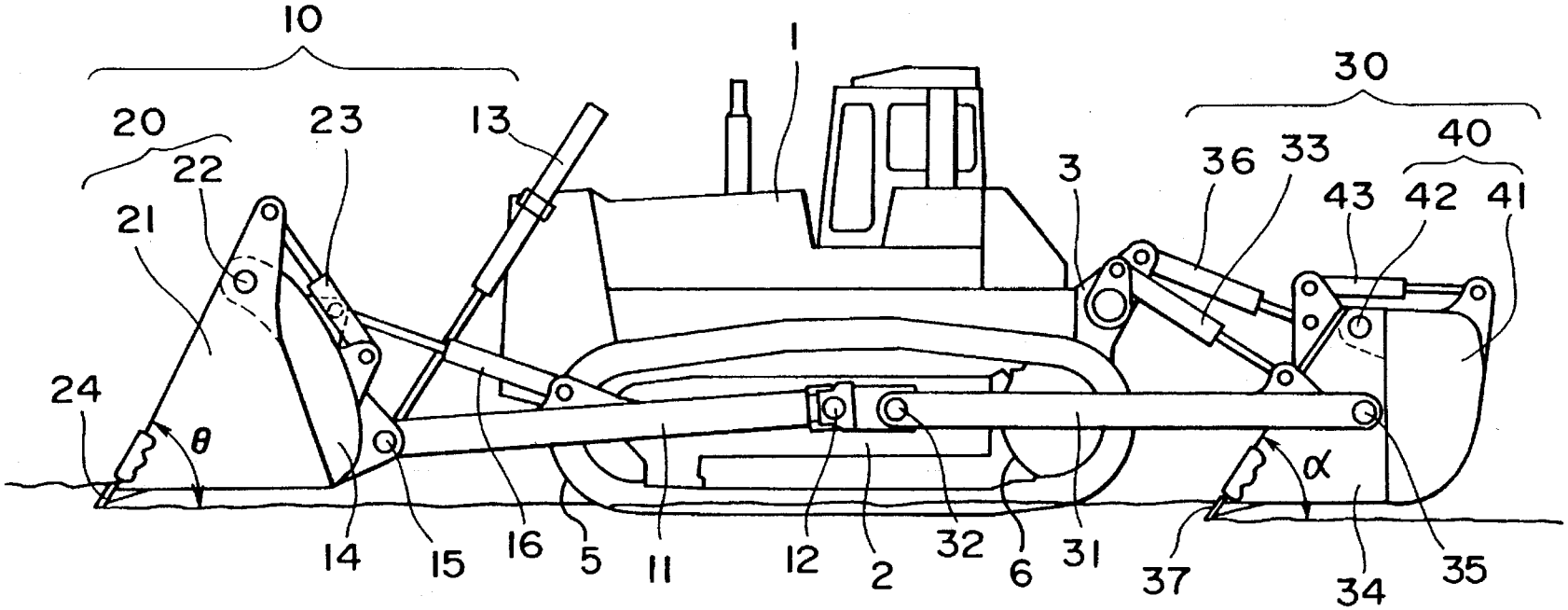
FIG. 1 is a side elevational view of a twin-scrape dozer according to a first embodiment of the present invention.
Figure 2:
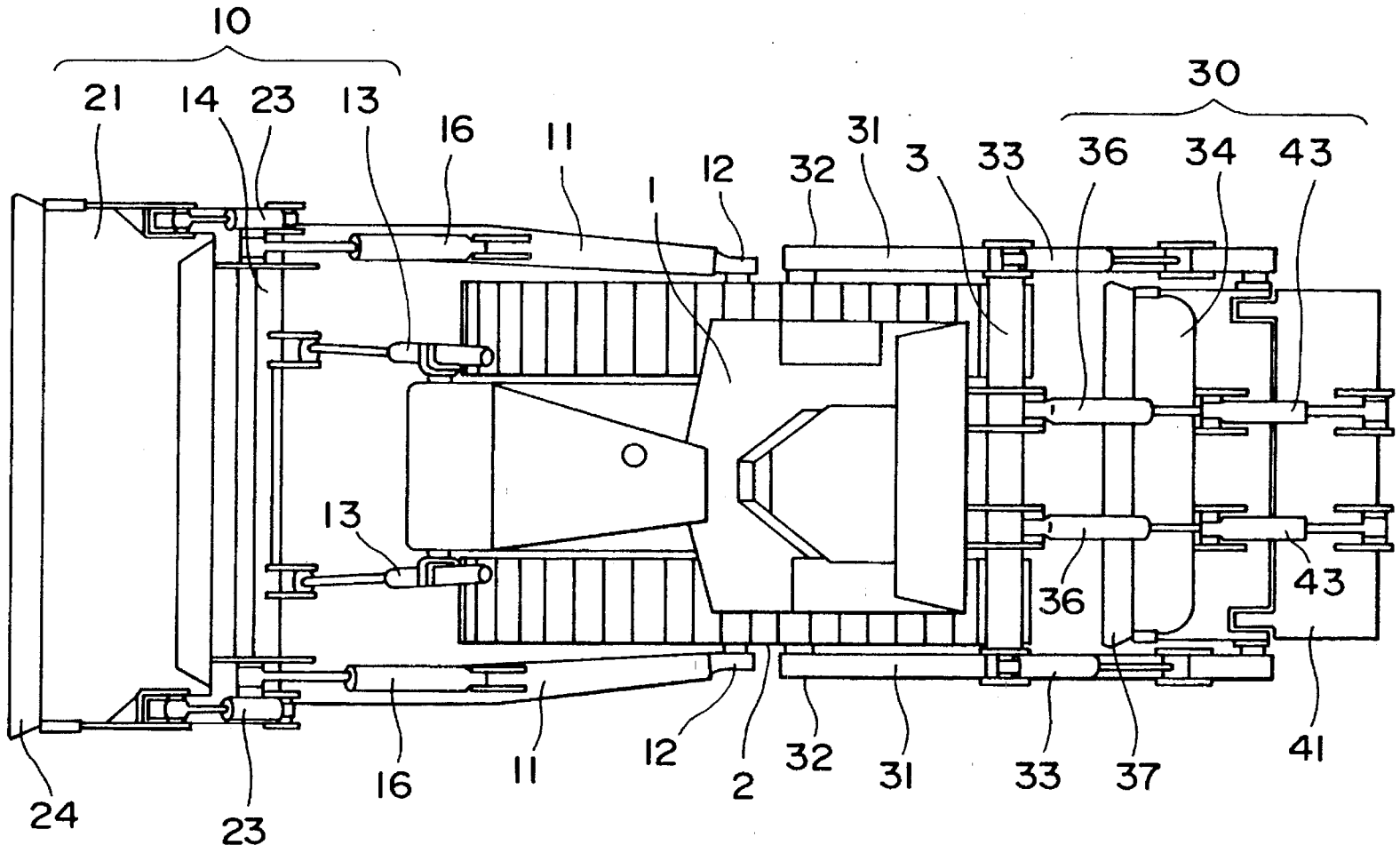
FIG. 2 is a plan view of the twin-scrape dozer of FIG. 1.

A twin-scrape dozer according to a first embodiment of the present invention is described in detail with reference to FIGS. 1 through 5.

A tractor 1 has right and left track frames 2, 2, a rear bracket 3, right and left track shoes 5, 5, right and left drive units 6, 6, a front bowl unit 10, and a rear bowl unit 30. The front bowl unit 10, which is an earth loading and ejecting device, is installed on a front part of a tractor 1. The rear ends of right and left frame members 11, 11 are pivotably mounted by pivot pins 12, 12 to the sides of the right and left track frames 2, 2 of the tractor 1 so that the frame members 11, 11 extend forwardly from the pivot pins 12, 12 past the front of the tractor 1. A bowl back member 14 is pivotably mounted by pivot pins 15, 15 to the forward ends of the right and left frame members 11, 11. The bowl back member 14 is also pivotably coupled to the frame of tractor 1 by a pair of front lift cylinders 13, 13, so that the frame members 11, 11 are pivoted about pins 12, 12 and the bowl back member 14 is moved vertically by extending and retracting the front lift cylinders 13, 13. An upper intermediate portion of the bowl back member 14 is pivotably coupled to intermediate portions of the right and left frame members 11, 11 by the tilt cylinders 16, 16.

An upper portion of the scraper 21 is pivotably mounted by pivot pins 22, 22 to an upper end portion of the bowl back member 14 so that the scraper 21 and the bowl back member 14 form a front bowl 20. An upper end portion of the scraper 21 above the pivot pins 22, 22 is pivotably coupled to a lower intermediate portion of the bowl back member 14 by bowl cylinders 23, 23 for providing relative movement about the pivot pins 22, 22 by extending and retracting the bowl cylinders 23, 23 so as to move a bottom portion of the scraper 21 and a bottom portion of the bowl back member 14 away from each other to form an ejection port 25 (FIG. 5) and toward each other to close the ejection port 25. The scraper 21 is provided with a cutting edge 24 at its extreme forward bottom end, and the excavating angle θ of the cutting edge 24 can be adjusted in accordance with the soil conditions by extending and retracting the tilt cylinders 16, 16.

The rear bowl unit 30, which is an earth loading and ejecting device, is installed on a rear part of the tractor 1. The front ends of right and left frame members 31, 31 are pivotably mounted by pivot pins 32, 32 to the sides of the right and left track frames 2, 2, so that the frame members 31, 31 extend rearwardly from the pivot pins 32, 32 past the rear of the tractor 1. The rear portions of the right and left frame members 31, 31 are pivotably coupled to the rear bracket 3 of the tractor 1 by rear lift cylinders 33, 33. A scraper 34 is pivotably mounted between the rear ends of the right and left frame members 31, 31 by pivot pins 35, 35. An upper portion of the scraper 34 is pivotably coupled to the rear bracket 3 by tilt cylinders 36, 36. The scraper 34 has a cutting edge 37 at its extreme forward bottom end.

A bowl back member 41 is pivotably mounted on an upper portion of the scraper 34 by pivot pins 42, 42 so as to be pivotable with respect to the scraper 34. The bowl back member 41 and the scraper 34 form a rear bowl 40. An upper portion of the bowl back member 41 is pivotably coupled to an upper portion of the scraper 34 by bowl cylinders 43, 43 for providing relative movement about the pivot pins 42, 42 by extending and retracting the bowl cylinders 43, 43 so as to move a bottom portion of the scraper 34 and a bottom portion of the bowl back member 41 away from each other to form an ejection port 44 (FIG. 5) and toward each other to close the ejection port 44. The rear bowl 40 can be moved vertically by extending and retracting the lift cylinders 33, 33, while the excavating angle e of the cutting edge 37 can be adjusted in accordance with the soil conditions by extending and retracting the tilt cylinders 36, 36.

The operation of the first embodiment of the invention is described below.

Figure 3:
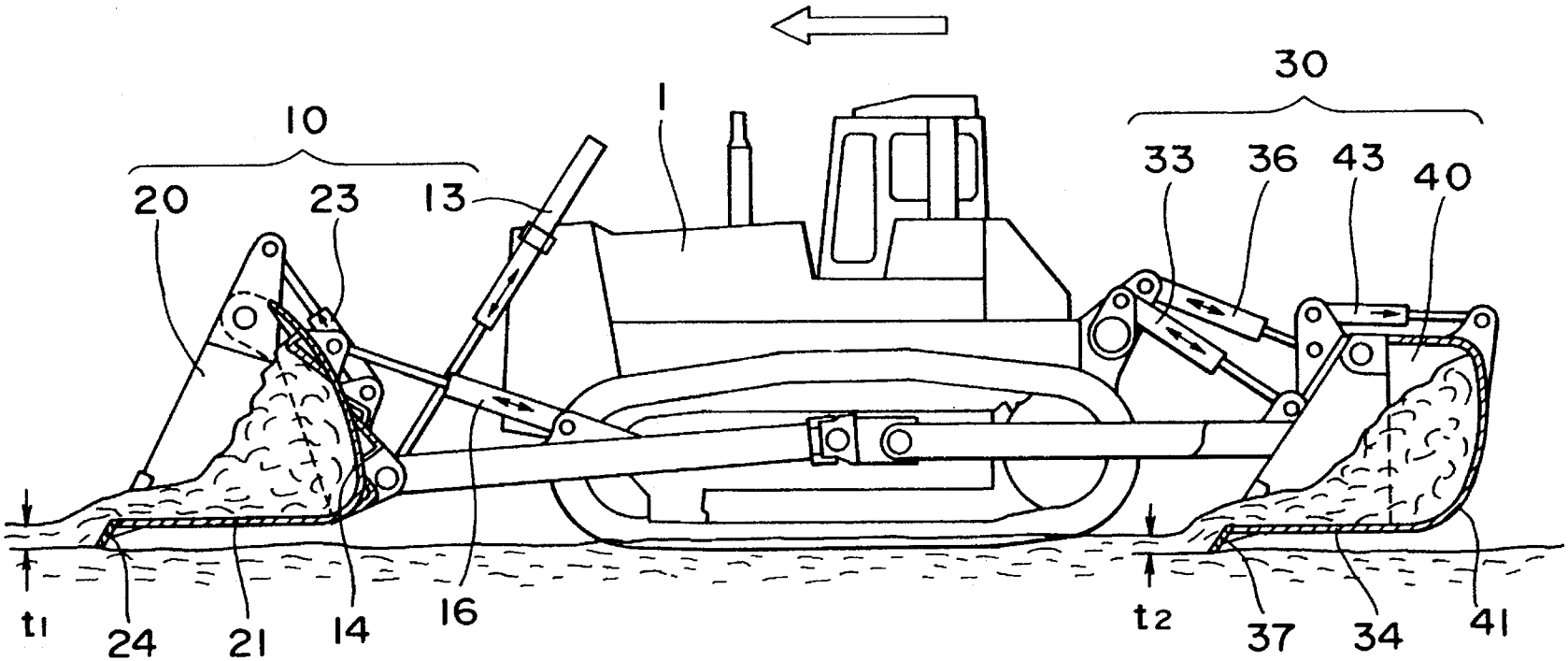
FIG. 3 is an illustration of an earth excavating and loading operation with the first embodiment of the invention.

In an earth excavating and loading operation, shown in FIG. 3, the bowl cylinders 23, 23 are extended so that the ejection port 25 at the bottom of the front bowl 20 is kept closed. The front bowl 20 is lowered by extending the lift cylinders 13, 13, and the tractor 1 is moved forwardly while the cutting edge 24 is maintained in the ground at a depth of $t_1$. The digging depth $t_1$ of the cutting edge 24 can be adjusted by the lift cylinders 13, 13 and/or by the tilt cylinders 16, 16. Earth is excavated by the cutting edge 24 and moved in sequence into the scraper 21 and the bowl back member 14.

Similarly the bowl cylinders 43, 43 are extended so that the ejection port 44 at the bottom of the rear bowl 40 is kept closed. The rear bowl 40 is lowered by extending the lift cylinders 33, 33, and the tractor 1 is moved forwardly while the cutting edge 37 is maintained in the ground at a depth of $t_2$. The digging depth $t_2$ of the cutting edge 37 can be adjusted by the lift cylinders 33, 33 and/or the tilt cylinders 36, 36. Earth is excavated by the cutting edge 37 and moved in sequence into the scraper 34 and the bowl back member 41.

Figure 4:
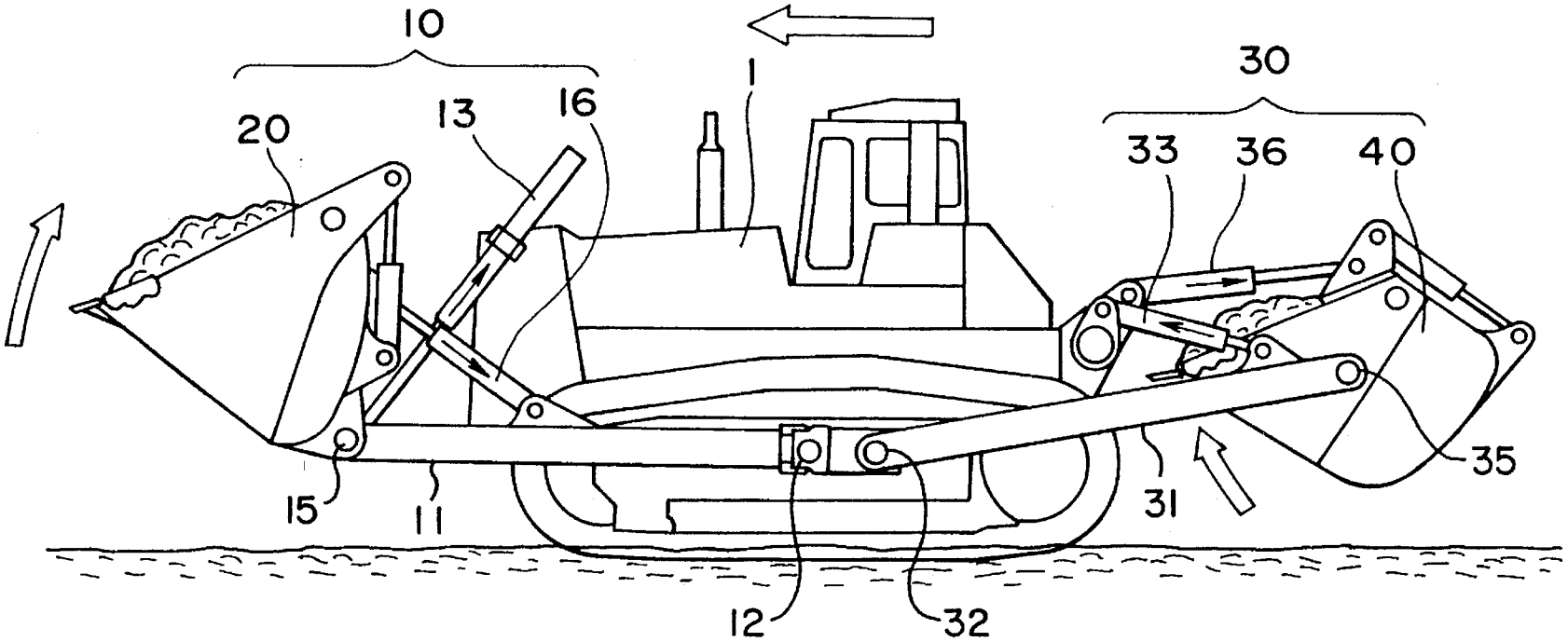
FIG. 4 is an illustration of a traveling and conveying operation with the first embodiment of the invention.

In an earth conveying work, shown in FIG. 4, when the front bowl 20 is filled with excavated earth, the front end of the front bowl 20 of the front bowl unit 10 is pivoted upwardly (as represented by a clockwise arrow in FIG. 4) about pivot pins 15, 15 by retracting the tilt cylinders 16, 16 to a holding position to prevent loaded earth from falling out of the front bowl 20. Similarly, when the rear bowl 40 of the rear bowl unit 30 is filled with excavated earth, the front portion of the rear bowl 40 is pivoted upwardly (as represented by a clockwise arrow in FIG. 4) about pivot pins 35, 35 by extending the tilt cylinders 36, 36 to a holding position to prevent loaded earth from falling out of the rear bowl 40.

The front bowl unit 10 is lifted upwardly to a traveling position for the front bowl 20 by retracting the lift cylinders 13, 13 to cause a rotation of the left and right front frame members 11, 11 about pivot pins 12, 12, while the rear bowl unit 30 is lifted upwardly to a traveling position for the rear bowl 40 by retracting the lift cylinders 33, 33 to cause a rotation of the left and right rear frame members 31, 31 about pivot pins 32, 32. Then the thus excavated and loaded earth is conveyed to the specified location. The center of gravity of the loaded vehicle is located near the center of the vehicle so that the vehicle is well balanced during travel.

Figure 5:
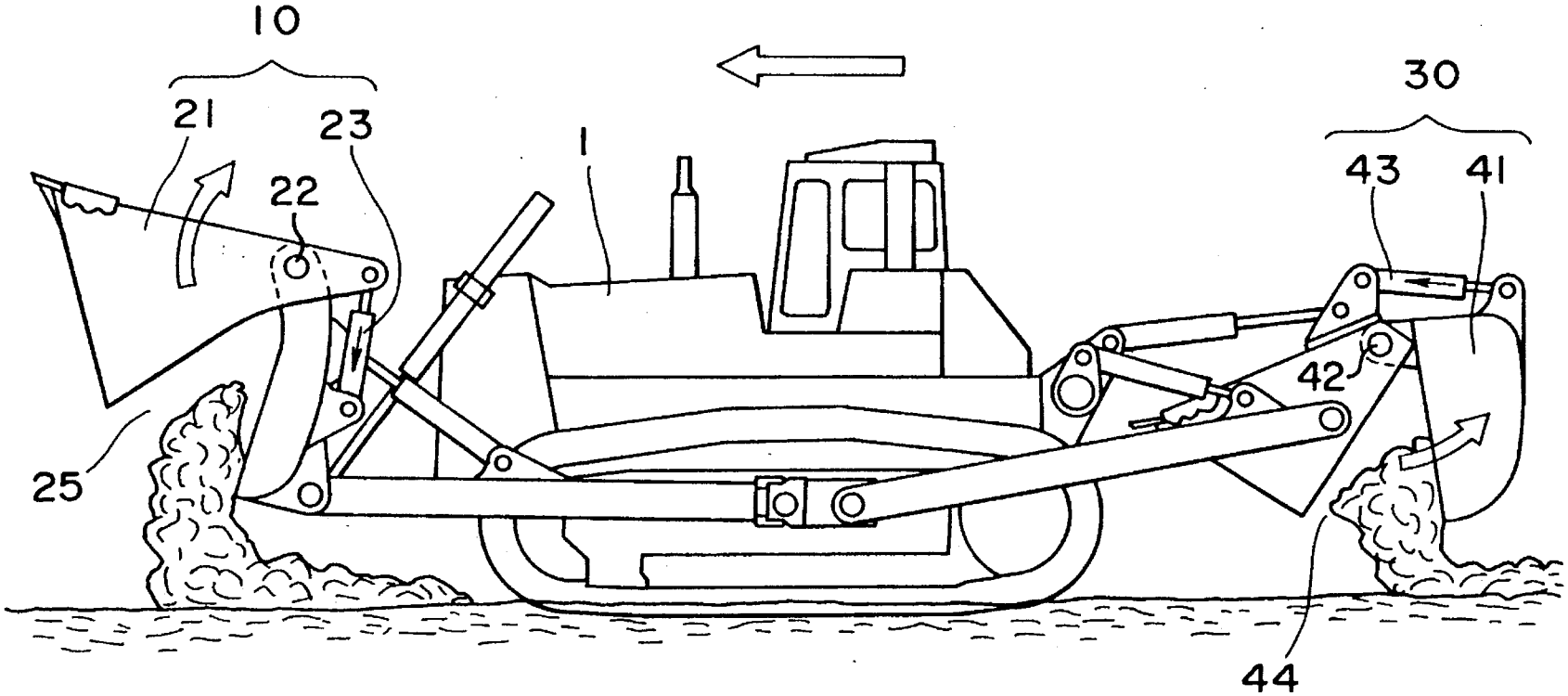
FIG. 5 is an illustration of an earth scattering and leveling operation with the first embodiment of the invention.

In an earth scattering and leveling operation, shown in FIG. 5, the scraper 21 of the front bowl unit 10 is pivoted upwardly about pivot pins 22, 22 (as shown by a clockwise arrow in FIG. 5) by retracting the bowl cylinders 23, 23 so that the ejection port 25 is opened to eject and scatter earth from the front bowl unit 10. The rate at which earth is scattered can be adjusted by adjusting the extent of the opening of the ejection port 25. The bowl back member 41 of the rear bowl unit 30 is pivoted upwardly about pivot pins 42, 42 (as shown by a counterclockwise arrow in FIG. 5) by retracting the bowl cylinders 43, 43 so that the ejection port 44 is opened to eject and scatter earth from the rear bowl unit 30. The rate at which earth is scattered can be adjusted by controlling the extent of the opening of the ejection port 44. Scattered earth can be leveled by dispersing the earth while operating the tractor 1 in a traveling mode.

Figure 6:
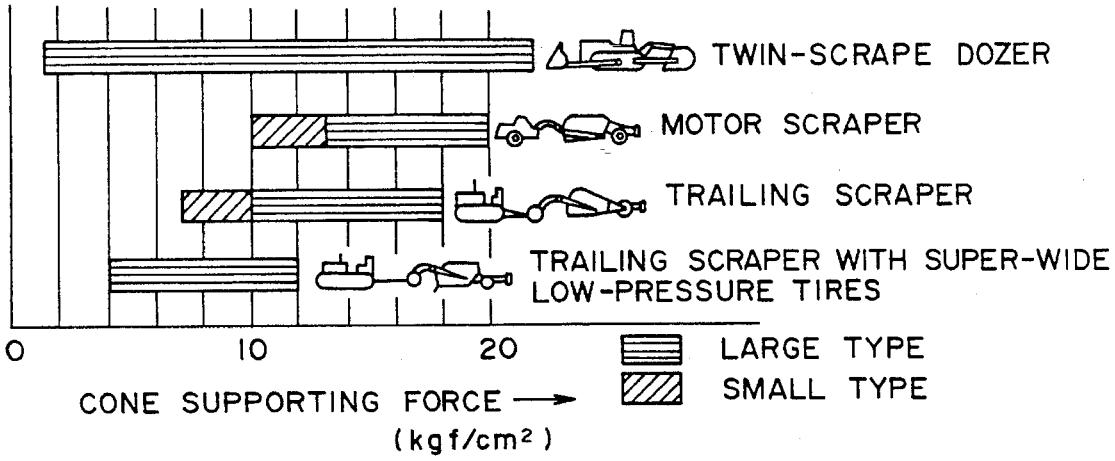
FIG. 6 is a graph showing the traveling limit of respective types of scrapers in reference to the cone supporting force.
Figure 7:
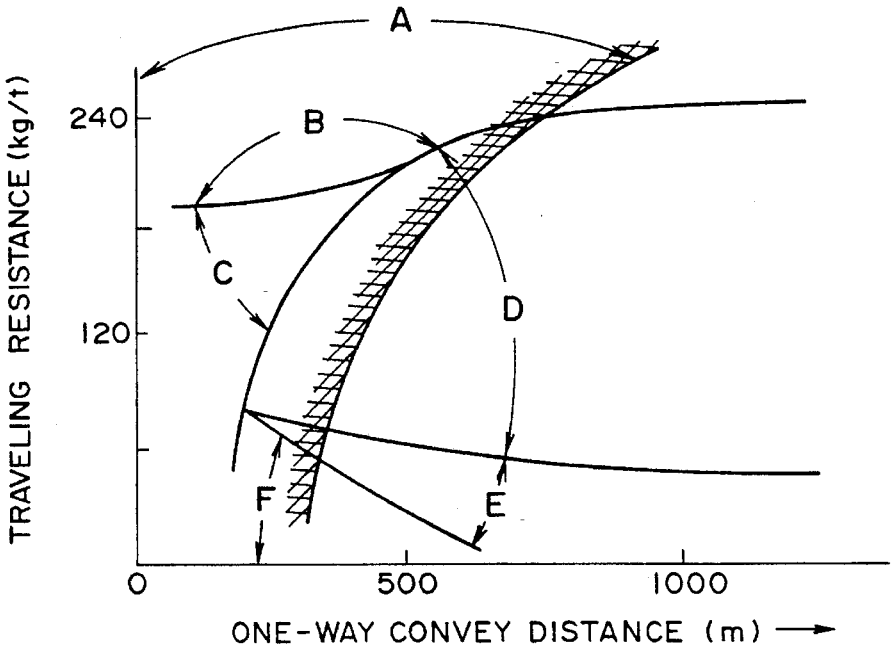
FIG. 7 is a graph showing the range of economical operation of respective types of machines in terms of conveying distance and traveling resistance.

Advantages of the first embodiment are described with reference to FIGS. 6 and 7. FIG. 6 is a graph showing the traveling limits of various types of scrapers in terms of the cone supporting force which represents the bearing force of the ground. It is apparent from the graph that even a large size version of the twin-scrape dozer of this embodiment is able to travel on various types of grounds, from a soft ground with a low cone supporting force to a ground with a high cone supporting force. FIG. 7 is a graph showing the economical operation range of various types of scrapers in terms of the conveying distance and the traveling resistance wherein the vertical axis denotes the traveling resistance and the horizontal axis denotes the one-way conveying distance. In FIG. 7, A is a twin-scrape dozer in accordance with the first embodiment of the present invention, B is a scrape dozer and a bulldozer, C is a trailing wheeled scraper, D is a twin-motor scraper, E is a motor scraper, and F is an elevating scraper. The twin-scrape dozer A of the present embodiment can be economically operated over a wide range of types of ground, from a ground with a small traveling resistance to a ground with a high traveling resistance, and is more useful for a work involving long conveying distances than are the conventional crawler type scrape dozers and bulldozers B.

Figure 8:
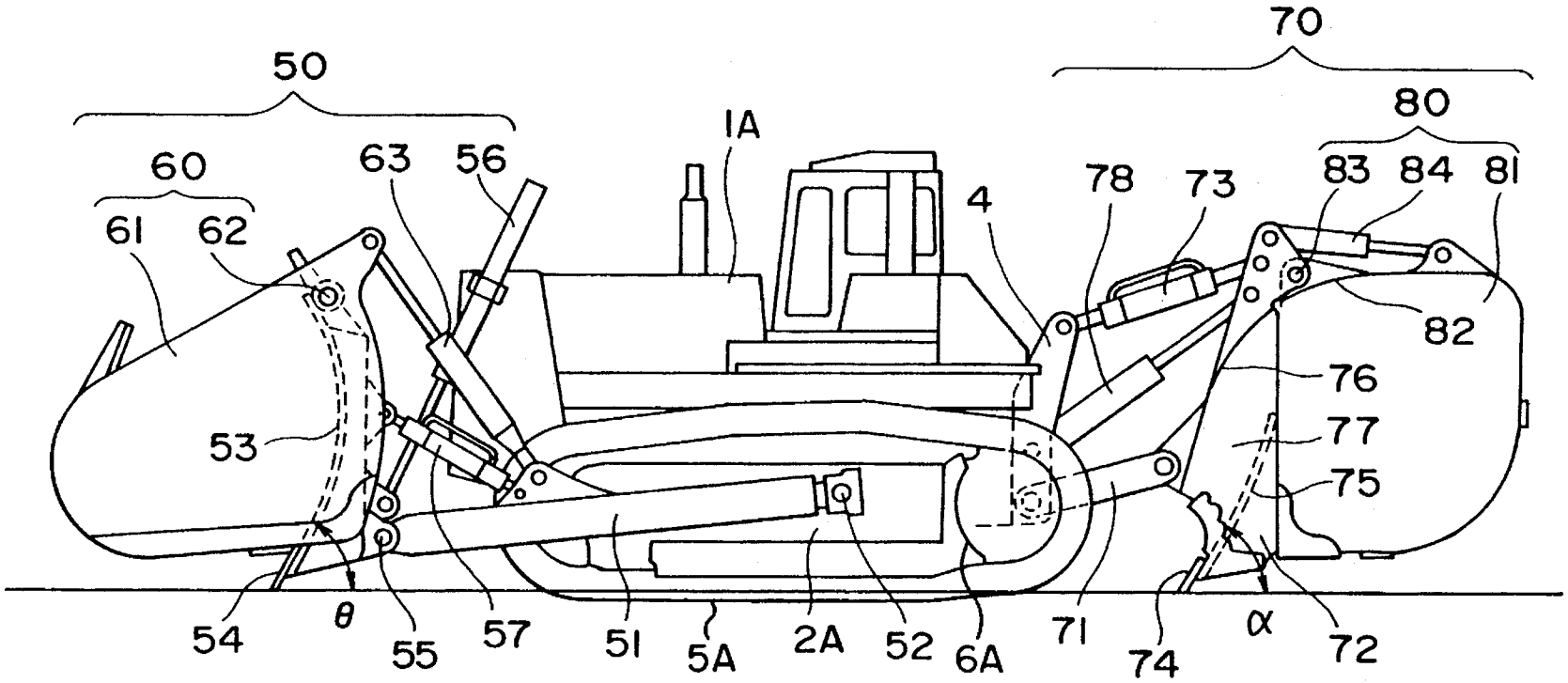
FIG. 8 is a side elevational view of the twin-scrape dozer according to a second embodiment of the present invention.
Figure 9:
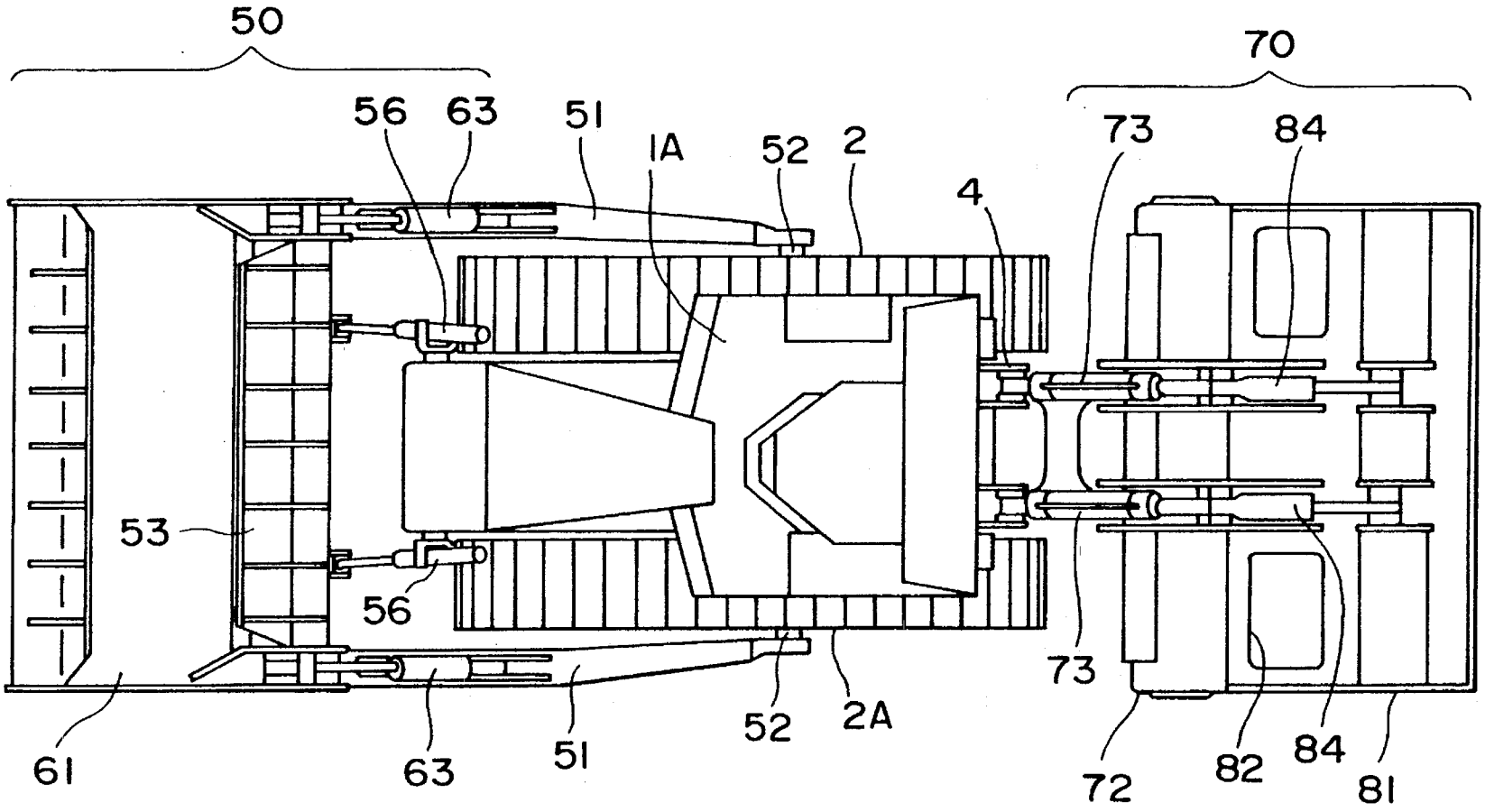
FIG. 9 is a plan view of the twin-scrape dozer of FIG. 8.

A twin-scrape dozer according to a second embodiment of the present invention is described in detail with reference to FIGS. 8 and 9.

A tractor 1A has right and left track frames 2A, 2A, a rear bracket 4, right and left track shoes 5A, 5A, right and left drive units 6A, 6A, a front scraper bowl unit 50, and a rear scraper bowl unit 70. The front scraper bowl unit 50, which is an earth loading and ejecting device, is installed at the front part of the tractor 1A. The rear ends of the right and left frame members 51, 51 are pivotably mounted by pivot pins 52, 52 to the respective sides of right and left track frames 2A, 2A of the tractor 1A so that the frame members 51, 51 extend forwardly from the pivot pins 52, 52 past the front of the tractor 1A. A lower portion of a scraper blade 53, having a cutting edge 54, is pivotably mounted by pivot pins 55, 55 to the front ends of the right and left frame members 51, 51. The scraper blade 53 is pivotably coupled to the frame of tractor 1A by front lift cylinders 56, 56 so that the scraper blade 53 can be moved vertically by extending and retracting the lift cylinders 56, 56. An intermediate portion of the scraper blade 53 is pivotably coupled to an intermediate portion of the right and left frame members 51, 51 by right and left adjustable length braces 57, 57. Each of the right and left braces 57, 57 can be in the form of two members in axially extending threaded engagement so that the length of the right and left braces 57, 57 can be adjusted by varying the extent of the threaded engagement. The excavating angle θ of the cutting edge 54 can be adjusted in accordance with the nature of the soil conditions by adjusting the length of the braces 57, 57. An upper portion of bowl member 61 is pivotably mounted to an upper portion of the scraper blade 53 by pivot pins 62, 62 so that the bowl member 61 and the scraper blade 53 form the front bowl 60. The upper end of the bowl member 61 is pivotably coupled to an intermediate portion of the right and left frame members 51, 51 by right and left bowl cylinders 63, 63 so that the ejection port 64 of the bottom of the front bowl 60 is opened and closed by extending and retracting these right and left bowl cylinders 63, 63 to rotate the bowl member 61 about pivot pins 62, 62.

A rear scraper bowl unit 70, which is an earth loading and ejecting device, is installed at the rear part of the tractor 1A. An intermediate portion of the scraper blade 72 is pivotably coupled by the right and left link members 71, 71, to a lower end portion of the rear bracket 4, which is fixed at the rear part of the tractor 1A. An upper end portion of the scraper blade 72 is pivotably coupled by right and left braces 73, 73 to an upper end portion of the rear bracket 4 to form a four-node linkage. The scraper blade 72 comprises a cutting plate 75, having the cutting edge 74 at its lower end, and a guide plate 76. A path 77 is provided between the cutting plate 75 and the guide plate 76. Each of the right and left adjustable length braces 73, 73 can be in the form of two members in axially extending threaded engagement so that the length of the right and left braces 73, 73 can be adjusted by varying the extent of the threaded engagement. The excavating angle e of the cutting edge 74 can be adjusted in accordance with the nature of the soil conditions by adjusting the length of the braces 73, 73. An upper portion of the scraper blade 72 is pivotably coupled by right and left rear lift cylinders 78, 78 to an intermediate portion of the rear bracket 4. The scraper blade 72 can be moved vertically by extending and retracting the right and left lift cylinders 78, 78. A bowl member 81, having windows 82 in its upper surface, is pivotably mounted by pivot pins 83, 83 to an upper part of the scraper blade 72 to form the rear bowl 80. An upper portion of the bowl 81 and an upper portion of the scraper blade 72 are also pivotably coupled to each other by right and left bowl cylinders 84, 84 so that the ejection port 85 of the bottom of the rear bowl 80 is opened and closed by extending and retracting these right and left bowl cylinders 84, 84.

The operation of the second embodiment is described below.

Figure 10:
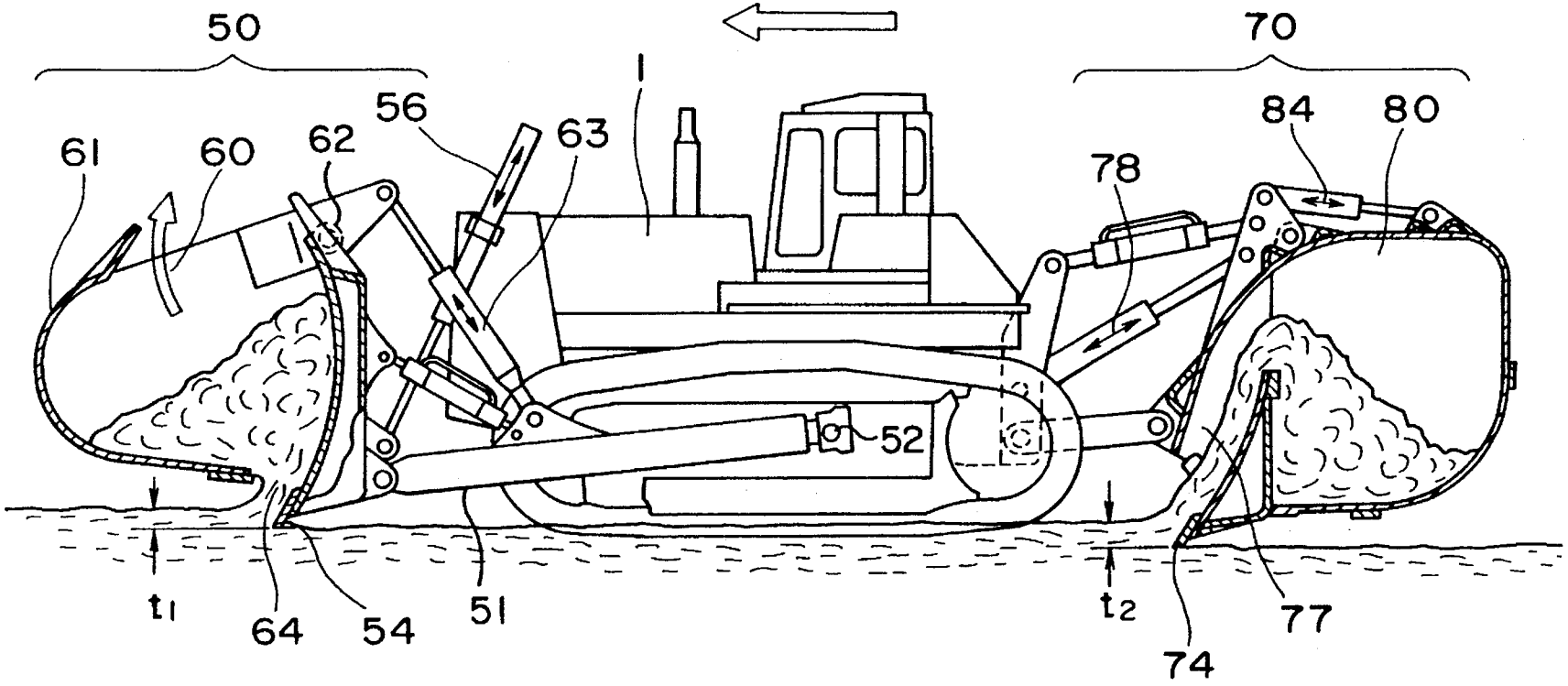
FIG. 10 is an illustration of an earth excavating and loading operation with the second embodiment of the FIGS. 11(A),11(B) and 11(c) are illustrations of an earth excavating and loading operation of the front bowl with the second embodiment of the invention.

In an excavating and loading operation with the front scraper bowl unit 50, shown in FIG. 10, the front bowl 60 is lowered by extending right and left lift cylinders 56, 56 to rotate the right and left frame members 51, 51 downwardly about pivot pins 52, 52 to press the cutting edge 54 against the ground and maintain the cutting edge 54 in the ground at a depth of $t_1$. The digging depth $t_1$ can be adjusted by extending and retracting right and left lift cylinders 56, 56. The bowl member 61 is pivoted upwardly about pivot pins 62, 62 (represented by a clockwise arrow) by retracting the right and left bowl cylinders 63, 63, so that the ejection port 64 at the bottom of the front bowl 60 is opened. When the tractor 1A is moved forwardly under the above condition, earth is excavated by the cutting edge 54 and moved into the front bowl 60 through the ejection port 64., FIGS. 11(A), 11(B) and 11(C) show such excavation process with the excavated earth being collected in the front bowl 60 in the order of FIGS. 11(A), 11(B), and 11(C).

On the other hand, in the rear scraper bowl unit 70, as shown in FIG. 10, the right and left bowl cylinders 84, 84 are extended so that the ejection port 85 in the bottom of the rear bowl 80 is closed. The rear bowl 80 is lowered by retracting right and left lift cylinders 78, 78 to press the cutting edge 74 against the ground and maintain the cutting edge 74 in the ground at a depth of $t_2$. The digging depth $t_2$ can be adjusted by extending and retracting the right and left lift cylinders 78, 78. When the tractor 1A is moved forwardly under this condition, earth is excavated by the cutting edge 74 and moved into the rear bowl 80 through the path 77. FIGS. 12(A), 12(B) and 12(C) shows the conditions during the collection of earth into the rear bowl 60 in the order of FIGS. 12(A), 12(B) and 12(C).

Figure 13:
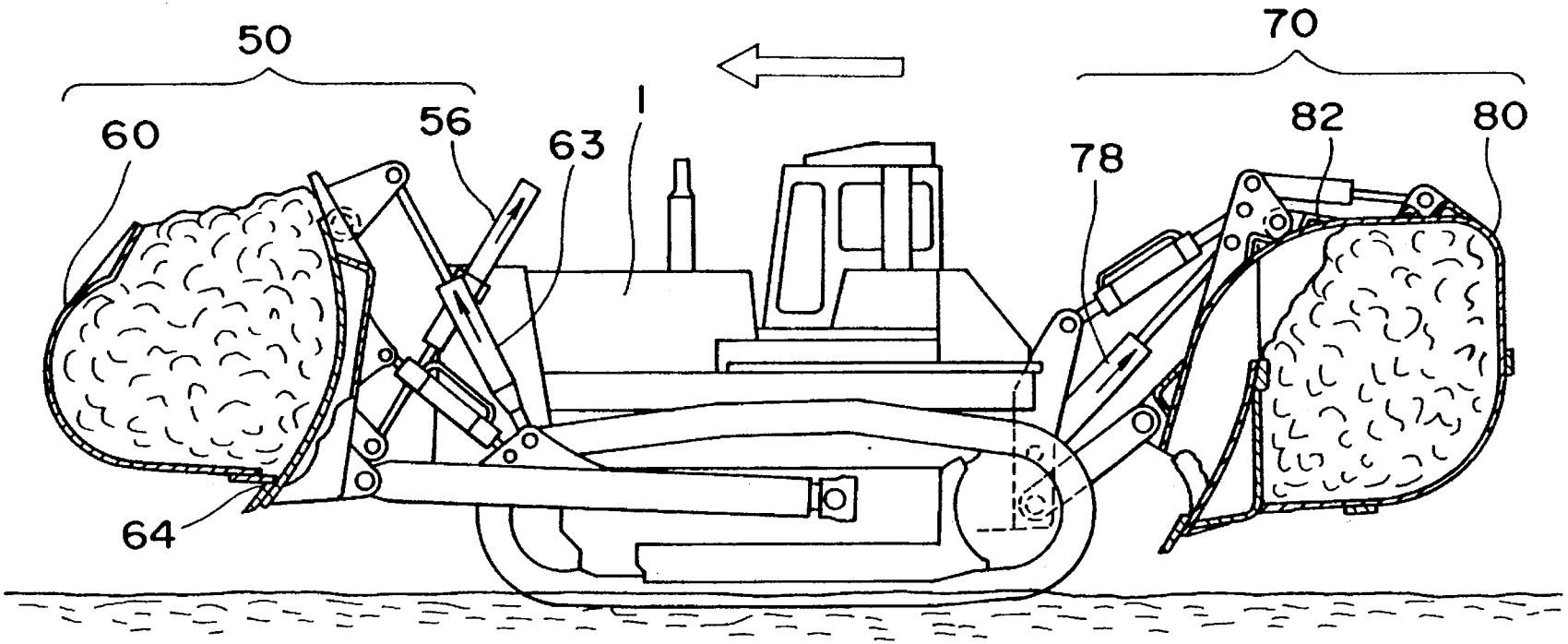
FIG. 13 is an illustration of a traveling and conveying operation with the second embodiment of the invention.

In an earth conveying operation, shown in FIG. 13, when the front bowl 60 is filled with earth, the ejection port 64 is closed by extending the right and left bowl cylinders 63, 63 to rotate the bowl member 61 downwardly (counterclockwise as viewed in FIG. 13) about pivot pins 62, 62, and the front scraper bowl unit 50 is lifted upwardly to a traveling position by retracting the right and left lift cylinders 56, 56. When it is determined by visual inspection through the windows 82 that the rear bowl 80 is filled with earth, the rear scraper bowl unit 70 is lifted upwardly to a traveling position by extending the right and left lift cylinders 78, 78. The earth in front bowl 60 and rear bowl 80 is then conveyed to a specified location.

Figure 14:
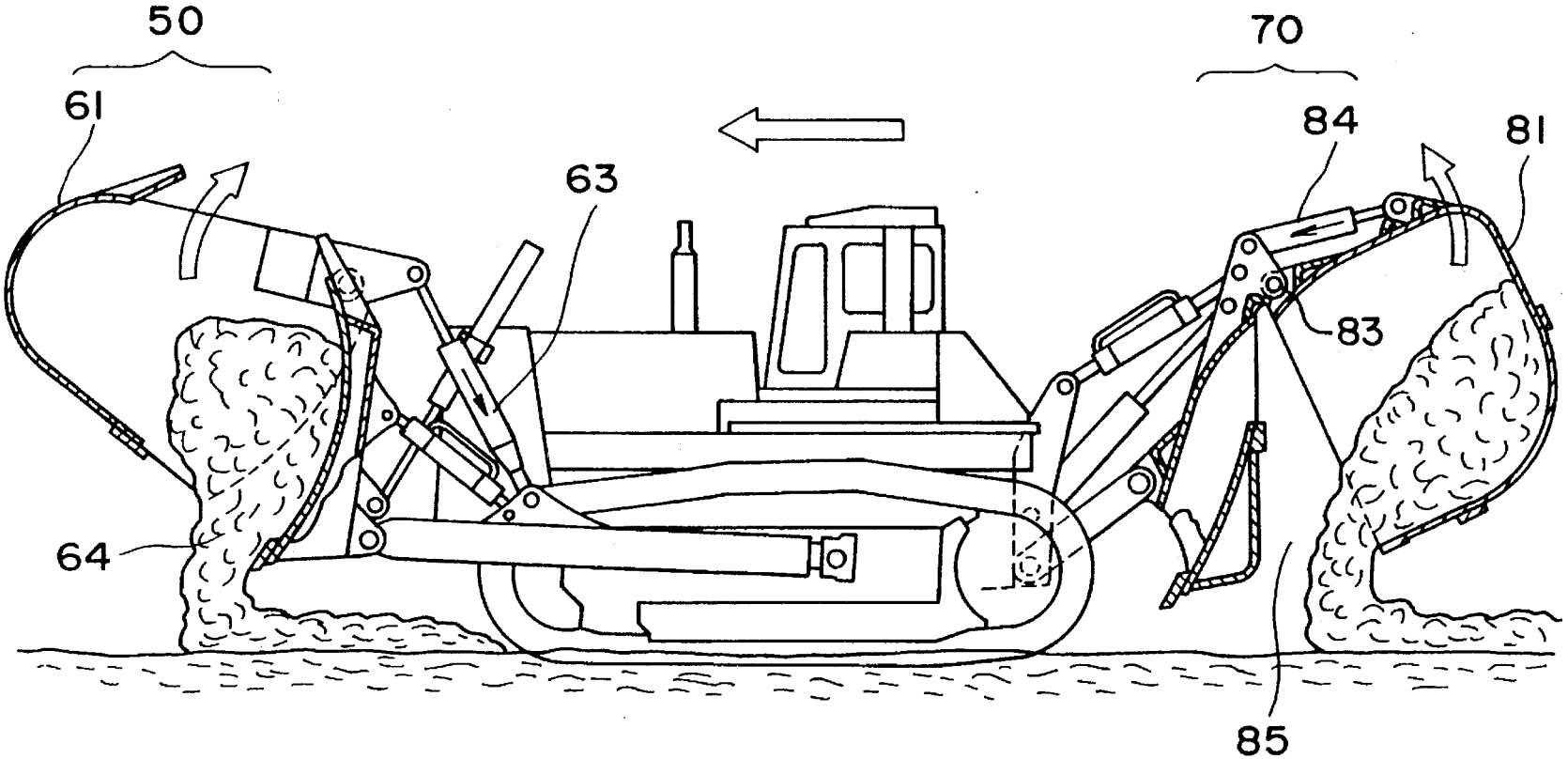
FIG. 14 is an illustration of an earth scattering and leveling operation with the second embodiment of the invention.
Figure 15:
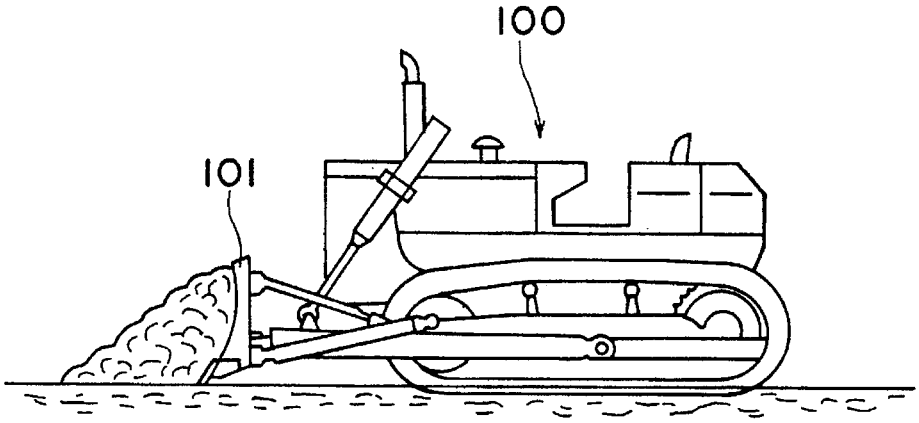
FIG.15 PRIOR ART
FIG. 15 is a side elevational view of a prior art bulldozer.
Figure 16:
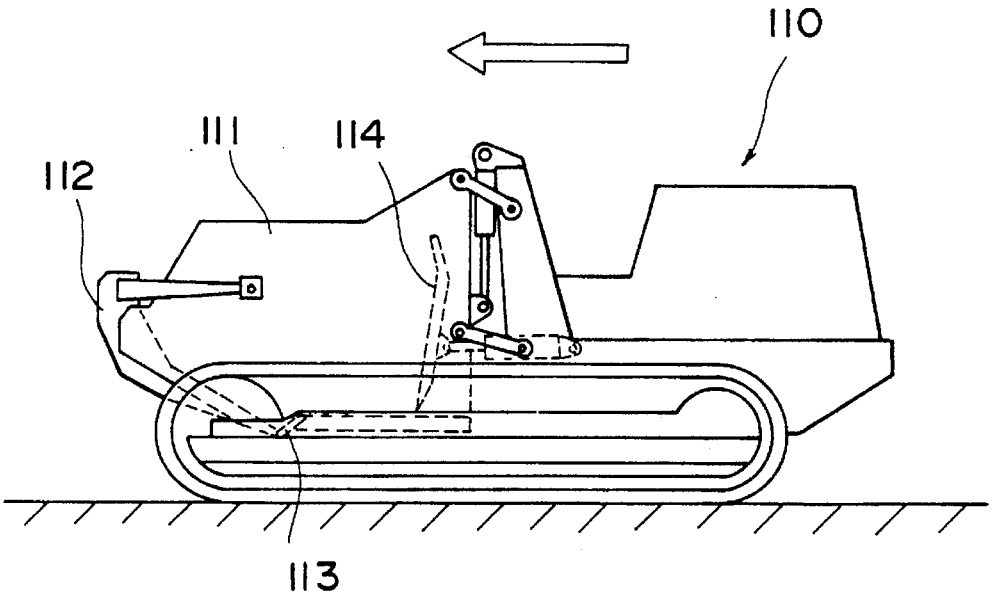
FIG.16 PRIOR ART
FIG. 16 is a side elevational view of a prior art scrape dozer.
Figure 17:
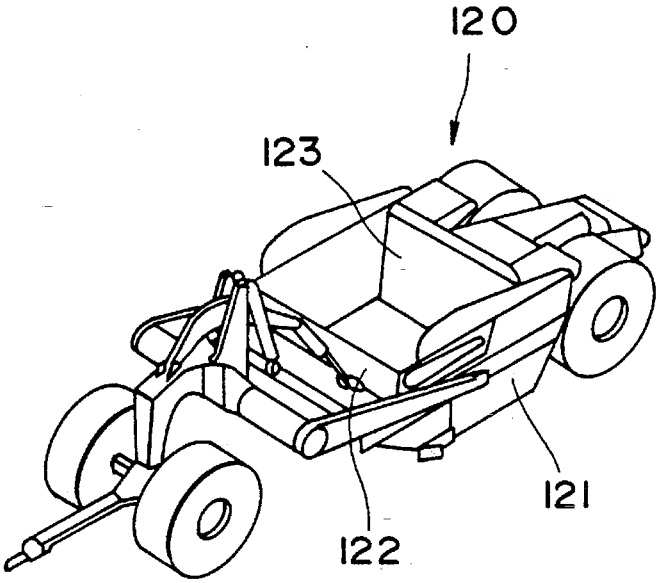
FIG.17 PRIOR ART
FIG. 17 is a perspective view of a prior art trailing wheeled scraper.
Figure 18:
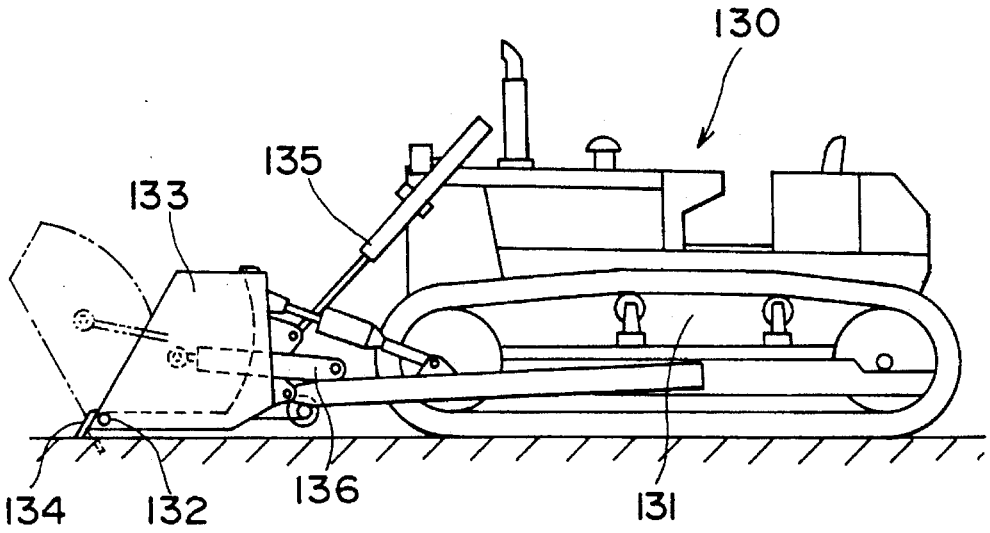
FIG.18 PRIOR ART
FIG. 18 is a side elevational view of a prior art bucket dozer.

In an earth scattering and leveling work with the front scraper bowl unit 50, as shown in FIG. 14, the bowl member 61 is pivoted upwardly (represented by a clockwise arrow) about pivot pins 55 by retracting the bowl cylinders 63, 63 so that the ejection port 64 is opened to scatter earth from front bowl 60. On the other hand, in the same work with the rear scraper bowl unit 70, the bowl member 81 is pivoted upwardly (represented by a counterclockwise arrow) about pivot pins 83, 83 by retracting the bowl cylinders 84, 84 so that the ejection port 85 is opened to scatter earth. The rate at which the earth is scattered can be adjusted by adjusting the extent of the opening of the ejection ports 64 and 85. The earth can be leveled by scattering the earth from the tractor 1A while the tractor 1A is traveling. The second embodiment provides advantages similar to those of the first embodiment.

INDUSTRIAL APPLICABILITY

The present invention is useful as a twin-scrape dozer which provides the following effects:

(1) The vehicle machine can be well balanced even when earth is loaded, and therefore the quantity of earth to be conveyed per unit vehicle weight can be large.

(2) Each earth loading and ejecting device is adapted to be moved vertically, and therefore the twin-scrape dozer can convey earth in a lifted condition so that the vehicle speed can be faster than that of the bulldozer conveying earth. Consequently, the amount of work per unit of time can be large, and the vehicle machine can be used economically even over long conveying distances.

(3) The ground contact pressure is lower than for a wheeled scraper, and therefore the vehicle machine can be used on a soft ground.

(4) The ejection port of each earth loading and ejecting device can be controlled to adjust the rate at which earth is scattered.

(5) The excavating angle of the scraper can be adjusted to improve the efficiency of work.

(6) An existing crawler type tractor can be used, and high reliability can therefore be ensured.

What is claimed is:

1. A twin-scrape dozer comprising:

a crawler tractor equipped with a traveling mechanism comprising left and right track frames provided at right and left sides of said crawler tractor, left and right track shoes, and left and right drive units;

a front earth loading and ejecting device mounted on a front portion of said crawler tractor;

at least one front lift cylinder for vertically moving said front earth loading and ejecting device;

a rear earth loading and ejecting device mounted on a rear portion of said crawler tractor; and at least one rear lift cylinder for vertically moving said rear earth loading and ejecting device;

wherein said front earth loading and ejecting device comprises a front scraper, said front scraper having a cutting edge at a forward bottom end thereof, a front bowl member pivotably connected to the front scraper by at least one front pivot pin, and at least one front bowl cylinder for providing relative movement between the front scraper and the front bowl member about the at least one front pivot pin in response to extending and retracting of said at least one front bowl cylinder so as to move a bottom portion of the front scraper and a bottom portion of the front bowl member away from each other to form a front ejection port and toward each other to close the front ejection port, and wherein said rear earth loading and ejecting device comprises a rear scraper, said rear scraper having a cutting edge at a forward bottom end thereof a rear bowl member pivotably connected to the rear scraper by at least one rear pivot pin, and at least one rear bowl cylinder for providing relative movement between the rear scraper and the rear bowl member about the at least one rear pivot pin in response to extending and retracting of said at least one rear bowl cylinder so as to move a bottom portion of the rear scraper and a bottom portion of the rear bowl member away from each other to form a rear ejection port and toward each other to close the rear ejection port;

whereby said front earth loading and ejecting device and said rear earth loading and ejecting device can be simultaneously utilized in an earth excavating and loading operation to load excavated material into said front bowl member and said rear bowl member while said crawler tractor is moving forwardly; and whereby said front earth loading and ejecting device and said rear earth loading and ejecting device can be simultaneously maintained in an elevated traveling position in a traveling and conveying operation with loaded excavated material in each of said front bowl member and said rear bowl member and with the center of gravity of the thus loaded dozer being near the center of the dozer so that the dozer is well balanced during travel.

2. A twin-scrape dozer in accordance with claim 1, wherein a rear bracket, fixed to a rear portion of said crawler tractor, is pivotably coupled by at least one rear tilt cylinder to the rear scraper so that an excavating angle of the rear scraper can be changed by extending and retracting the at least one rear tilt cylinder.

3. A twin-scrape dozer in accordance with claim 1 wherein the front earth loading and ejecting device is pivotably connected to at least one front tilt cylinder so that an excavating angle of the front scraper can be changed by extending and retracting the at least one front tilt cylinder.

4. A twin-scrape dozer in accordance with claim 1 wherein said front earth loading and ejecting device further comprises left and right front frame members having rear end portions pivotably mounted to the right and left track frames and front end portions pivotably mounted to a lower portion of the front bowl member, and wherein an upper portion of the front bowl member is pivotably coupled by at least one front tilt cylinder to at least one of the left and right front frame members so that an excavating angle of the front scraper can be changed by extending and retracting the at least one front tilt cylinder.

5. A twin-scrape dozer in accordance with claim 1, wherein said front earth loading and ejecting device further comprises left and right front frame members, each of the left and right front frame members having a front end portion, an intermediate portion, and a rear end portion, the rear end portions of the left and right front frame members being pivotably mounted to the right and left track frames;

wherein said at least one front pivot pin connects an upper portion of the front scraper and an upper end portion of the front bowl member;

wherein a lower portion of the front bowl member is pivotably mounted to the front end portions of the left and right front frame members; and wherein the front bowl member is pivotably coupled by a pair of front tilt cylinders to the intermediate portion of the left and right front frame members so that an excavating angle of the front scraper can be changed by extending and retracting the pair of front tilt cylinders.

6. A twin-scrape dozer in accordance with claim 5, wherein the front bowl cylinder is pivotably connected between an intermediate portion of the front bowl member and an upper end portion of the front scraper above said at least one front pivot pin.

7. A twin-scrape dozer in accordance with claim 5, wherein a rear bracket, fixed to a rear portion of said crawler tractor, is pivotably coupled by at least one rear tilt cylinder to the rear scraper so that an excavating angle of the rear scraper can be changed by extending and retracting the at least one rear tilt cylinder.

8. A twin-scrape dozer in accordance with claim 7, wherein said rear earth loading and ejecting device further comprises left and right rear frame members, each of the left and right rear frame members having a front end portion, an intermediate portion, and a rear end portion, the front end portions of the left and right rear frame members being pivotably mounted to the right and left track frames; and wherein the rear scraper is pivotably mounted to the rear end portions of the left and right rear frame members.

9. A twin-scrape dozer in accordance with claim 8, wherein said at least one rear pivot pin connects an upper portion of the rear scraper and an upper portion of the rear bowl member; and wherein the at least one rear bowl cylinder is pivotably connected between an upper end portion of the rear scraper and an upper end portion of the rear bowl member.

10. A twin-scrape dozer in accordance with claim 9, wherein each of the front scraper and the rear scraper comprises a scraper blade having a cutting edge at an extreme forward end thereof.

11. A twin-scrape dozer in accordance with claim 1, wherein said front earth loading and ejecting device further comprises left and right front frame members pivotably mounted to the right and left track frames, and wherein the front bowl member is pivotably coupled by at least one adjustable length front brace to at least one of the left and right front frame members so that an excavating angle of the front scraper can be changed by adjusting the length of the at least one adjustable length front brace wherein each said at least one adjustable length front brace comprises two members in axially extending threaded engagement so that the length of the respective brace can be adjusted by varying the extent Of the threaded engagement Of the respective two members.

12. A twin-scrape dozer in accordance with claim 1, wherein a rear bracket, fixed to a rear portion of said crawler tractor, is pivotably coupled by at least one adjustable length rear brace to the rear scraper so that an excavating angle of the rear scraper can be changed by adjusting the length of said at least one adjustable length rear brace, wherein each said at least One adjustable length rear brace comprises two member in axially extending threaded engagement so that the length of the respective brace can be adjusted by varying the extent of the threaded engagement of the respective two members.

13. A twin-scrape dozer in accordance with claim 1, wherein an upper end portion of a rear bracket, fixed to a rear portion of said crawler tractor, is pivotably coupled by at least one adjustable length rear brace to an upper portion of the rear scraper, and wherein a lower end portion of said rear bracket is pivotably coupled by at least one link member to an intermediate portion of the rear scraper to form a four-node linkage, so that an excavating angle of the rear scraper can be changed by adjusting the length of said at least one adjustable length rear brace, wherein each said at least One adjustable length rear brace comprises two members in axially extending threaded engagement so that the length of the respective brace can be adjusted by varying the extent of the threaded engagement ok the respective two members.

14. A twin-scrape dozer in accordance with claim 13 wherein said at least one rear lift cylinder for vertically moving said rear earth loading and ejecting device is pivotably connected between said rear bracket and the rear scraper.

15. A twin-scrape dozer in accordance with claim 14 wherein said front earth loading and ejecting device further comprises left and right front frame members pivotably mounted to the right and left track frames, wherein the front bowl member is pivotably coupled by at least one adjustable length front brace to at least one of the left and right front frame members so that an excavating angle of the front scraper can be changed by adjusting the length of the at least one adjustable length front brace, and wherein the at least one front bowl cylinder is pivotably connected between an upper portion of the front bowl member and at least one of said left and right front frame members, wherein each said at least one adjustable length front brace comprises two members in axially extending threaded engagement so that the length of the respective brace can be adjusted by varying the extent of the threaded engagement of the respective two members.

16. A twin-scrape dozer in accordance with claim 13, wherein said front earth loading and ejecting device further comprises left and right front frame members pivotably mounted to the right and left track frames, wherein the front bowl member is pivotably coupled by at least one adjustable length front brace to at least one of the left and right front frame members so that an excavating angle of the front scraper can be changed by adjusting the length of the at least one adjustable length front brace, and wherein the at least one front bowl cylinder is pivotably connected between an upper portion of the front bowl member and at least one of said left and right front frame members, wherein each said at least one adjustable length front brace comprises two members in axially extending threaded engagement so that the length of the respective brace can be adjusted by varying the extent of the threaded engagement of the respective two members.

17. A twin-scrape dozer in accordance with claim 1 wherein a rear bracket, fixed to a rear portion of said crawler tractor, is pivotably coupled by at least one rear tilt cylinder to the rear earth loading and ejecting device so that an excavating angle of the rear earth loading and ejecting device can be changed by extending and retracting the at least one rear tilt cylinder.

18. A twin-scrape dozer in accordance with claim 1, wherein the front earth loading and ejecting device is pivotably connected to at least one front tilt cylinder so that an excavating angle of the front earth loading and ejecting device can be changed by extending and retracting the at least one front tilt cylinder.

* * * * *